US010258847B2

(12) United States Patent
Loftus

(10) Patent No.: US 10,258,847 B2
(45) Date of Patent: Apr. 16, 2019

(54) GOLF CLUB CLEANING DEVICE AND METHOD OF USE

(71) Applicant: Kevin Loftus, Newtown Square, PA (US)

(72) Inventor: Kevin Loftus, Newtown Square, PA (US)

( * ) Notice: Subject to any disclaimer, the term of this patent is extended or adjusted under 35 U.S.C. 154(b) by 0 days.

(21) Appl. No.: 15/196,623

(22) Filed: Jun. 29, 2016

(65) Prior Publication Data

US 2017/0001086 A1 Jan. 5, 2017

Related U.S. Application Data

(60) Provisional application No. 62/187,356, filed on Jul. 1, 2015, provisional application No. 62/264,073, filed on Dec. 7, 2015.

(51) Int. Cl.

| | |
|---|---|
| ***A63B 57/60*** | (2015.01) |
| ***B08B 1/00*** | (2006.01) |
| ***A46B 15/00*** | (2006.01) |
| ***B08B 3/10*** | (2006.01) |

(52) U.S. Cl.

CPC ..... *A63B 57/60* (2015.10); *A46B 15/00* (2013.01); *B08B 1/00* (2013.01); *B08B 1/002* (2013.01); *B08B 3/10* (2013.01); *A46B 2200/3073* (2013.01)

(58) Field of Classification Search

CPC .. A46B 9/00; A46B 9/02; A46B 11/00; A46B 11/001; A46B 11/0062; A46B 15/00; A46B 2200/3073; A63B 57/00; A63B 57/60; A63B 60/36; B08B 1/00; B08B 1/001; B08B 1/002; B08B 3/00; B08B 3/04; B08B 7/04; B08B 2203/00; B08B 2240/00

USPC ... 15/21.1, 21.2, 88, 88.1, 104.92, 160, 264; 134/84, 92, 182, 183

See application file for complete search history.

(56) References Cited

U.S. PATENT DOCUMENTS

| | | | | | |
|---|---|---|---|---|---|
| 2,321,981 | A * | 6/1943 | Bowers | A47J 47/18 | 15/264 |
| 2,646,808 | A * | 7/1953 | Yenne | B44D 3/121 | 134/104.4 |
| 3,748,676 | A * | 7/1973 | Warren | A63B 47/04 | 15/104.92 |
| 4,734,952 | A * | 4/1988 | Parchment | A63B 57/60 | 15/104.92 |

(Continued)

FOREIGN PATENT DOCUMENTS

| | | | |
|---|---|---|---|
| DE | 29702435 | * | 6/1997 |
| FR | 2854577 | * | 11/2004 |

(Continued)

*Primary Examiner* — Mark Spisich

(74) *Attorney, Agent, or Firm* — John F. A. Earley, III; Harding, Earley, Follmer & Frailey, P.C.

(57) ABSTRACT

A cleaning device for cleaning golf club heads includes a cleaning chamber having an interior that houses a cleaning solution, and an opening leading to the interior. A lid is removably affixed over the opening. The lid moves between a closed position in which the lid covers the opening to close off the interior, and an opened position in which the lid is displaced from the opening to expose the interior. The lid, when in the opened position, allows for passage of a golf club head through the opening and into the interior.

23 Claims, 15 Drawing Sheets

(56) References Cited

U.S. PATENT DOCUMENTS

| | | | | | |
|---|---|---|---|---|---|
| 4,955,746 | A | | 9/1990 | Craigmile | |
| 5,081,735 | A | * | 1/1992 | Wyatt | A63B 57/60 15/104.92 |
| 5,155,883 | A | * | 10/1992 | Legault | A63B 57/60 15/21.2 |
| 5,404,610 | A | | 4/1995 | Coyer, Sr. et al. | |
| 5,611,104 | A | * | 3/1997 | DeMars | A47L 13/58 100/132 |
| 5,732,435 | A | * | 3/1998 | Williams | A46B 11/0003 15/104.92 |
| 6,317,916 | B1 | | 11/2001 | Smith | |
| 6,430,770 | B1 | | 8/2002 | Glass | |
| 6,745,424 | B1 | | 6/2004 | Pimentel et al. | |
| D505,474 | S | | 5/2005 | Crippen | |
| 6,938,296 | B1 | | 9/2005 | Scheuermann | |
| 7,162,766 | B1 | * | 1/2007 | Yakopcic | A46B 11/001 15/104.92 |
| 7,971,308 | B1 | * | 7/2011 | Lawson | A46B 13/006 15/104.92 |
| 8,393,041 | B2 | | 3/2013 | Cieri | |
| 9,566,488 | B1 | * | 2/2017 | Welch | A63B 57/60 |
| 2002/0069472 | A1 | * | 6/2002 | Glass | A63B 57/60 15/104.92 |
| 2010/0306936 | A1 | | 12/2010 | Hernandez Manero et al. | |

FOREIGN PATENT DOCUMENTS

| | | | |
|---|---|---|---|
| GB | 2268413 | * | 1/1994 |
| WO | WO20090601131 | | 5/2009 |

* cited by examiner

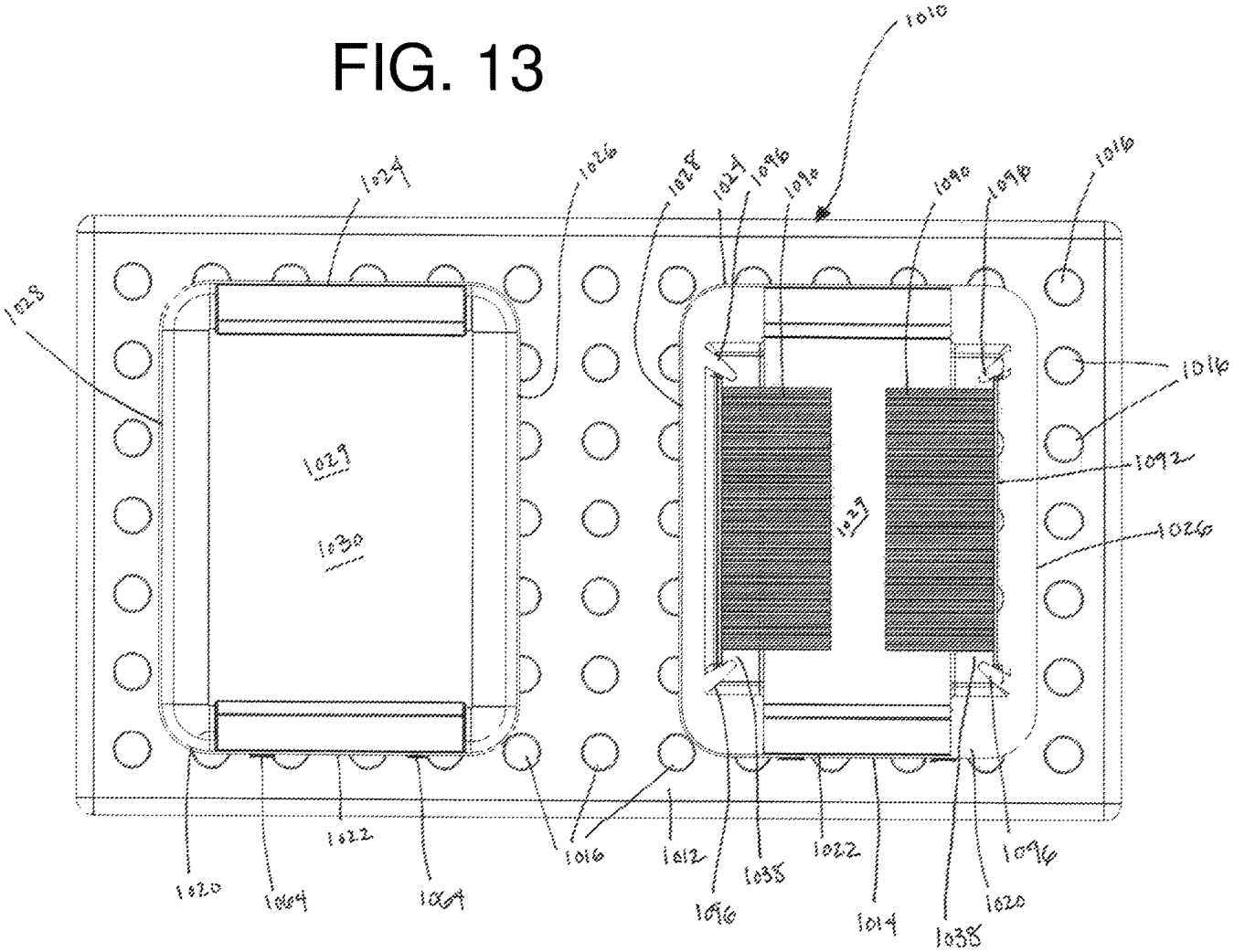
1010
1012
1014
1016
1018
1020
1022
1024
1026
1028
1029
1030
1032
1034
1035
1036
1038
1040
1042
1044
1046
1048
1050
1052
1054
1056
1058
1060
1062
1064
1066
1068
1070
1072
1074
1076
1078
1080
1082
1084
1086
1088
1090
1092
1094
1096
1098
1100
1102
1104
1106
1108
1110
1112
1114

GOLF CLUB CLEANING DEVICE AND METHOD OF USE

CROSS REFERENCE TO RELATED APPLICATIONS

This application claims the benefit of U.S. Provisional Patent Application No. 62/187,356, filed Jul. 1, 2015 and U.S. Provisional Patent Application No. 62/264,073, filed Dec. 7, 2015, each of which is incorporated herein by reference as if fully set forth.

FIELD OF INVENTION

The invention relates generally to cleaning devices. More specifically, the invention relates to portable devices for cleaning golf clubs.

BACKGROUND

The game of golf involves setting a ball on the ground and striking it with the head of a club, in an attempt to mobilize the ball and land it in a hole in the ground. During the process off striking the ball, the head may become soiled due to contact with the ground, which is typically a layer of grass covering dirt. Dirt may become caked on the club head, which is often driven into the dirt with a great deal of force.

Because the presence of dirt on a club head may affect a player's ability to accurately strike the ball during future swings, a number of devices exist for cleaning golf clubs during the game of golf. Such devices may be utilized immediately before striking the ball, to remove any dirt on the club head. The club head is then clean and ready to strike the ball. Often players ignore the need to clean club heads at the end of a golf game, and as a result the dirt dries out and may be difficult to remove prior to future games. Because golf is typically played away from a player's home, it may be inconvenient to clean club heads following a game in the absence of an effective and portable cleaning device. A need exists for a portable cleaning device for cleaning golf club heads upon completion of a game of golf.

SUMMARY

The invention relates to a cleaning device for cleaning golf club heads, including a cleaning chamber having an interior that houses a cleaning solution, and an opening leading to the interior. A lid is removably affixed over the opening. The lid moves between a closed position in which the lid covers the opening to close off the interior, and an opened position in which the lid is displaced from the opening to expose the interior. The lid, when in the opened position, allows for passage of a golf club head through the opening and into the interior.

The invention further relates to a cleaning device for cleaning golf club heads, including a base, a cleaning chamber having bottom wall, a side wall that extends upward from the bottom wall, and an upper opening sized to receive a golf club head. The base and the side wall define an interior. The device further includes a cleaning insert disposed within the chamber. The insert includes at least one orienting structure configured to allow passage of a golf club head into the cleaning chamber only when the golf club head is positioned at a selected rotational orientation.

The invention further relates to a cleaning device for cleaning golf club heads, including a cleaning chamber having an interior and including at least one cleaning material within the interior, a top wall removably affixed over the cleaning chamber to close off the interior. The top wall defines an opening. The device further includes a cap that moves between a closed position in which the cap is affixed over the opening, and an opened position in which the cap is removed from the opening to allow for passage of a golf club head therethrough.

BRIEF DESCRIPTION OF THE DRAWINGS

FIG. 13 is a top plan view of the golf club cleaning device of FIG. 10, shown with the top walls removed.

DETAILED DESCRIPTION OF THE PREFERRED EMBODIMENTS

Figure 1:
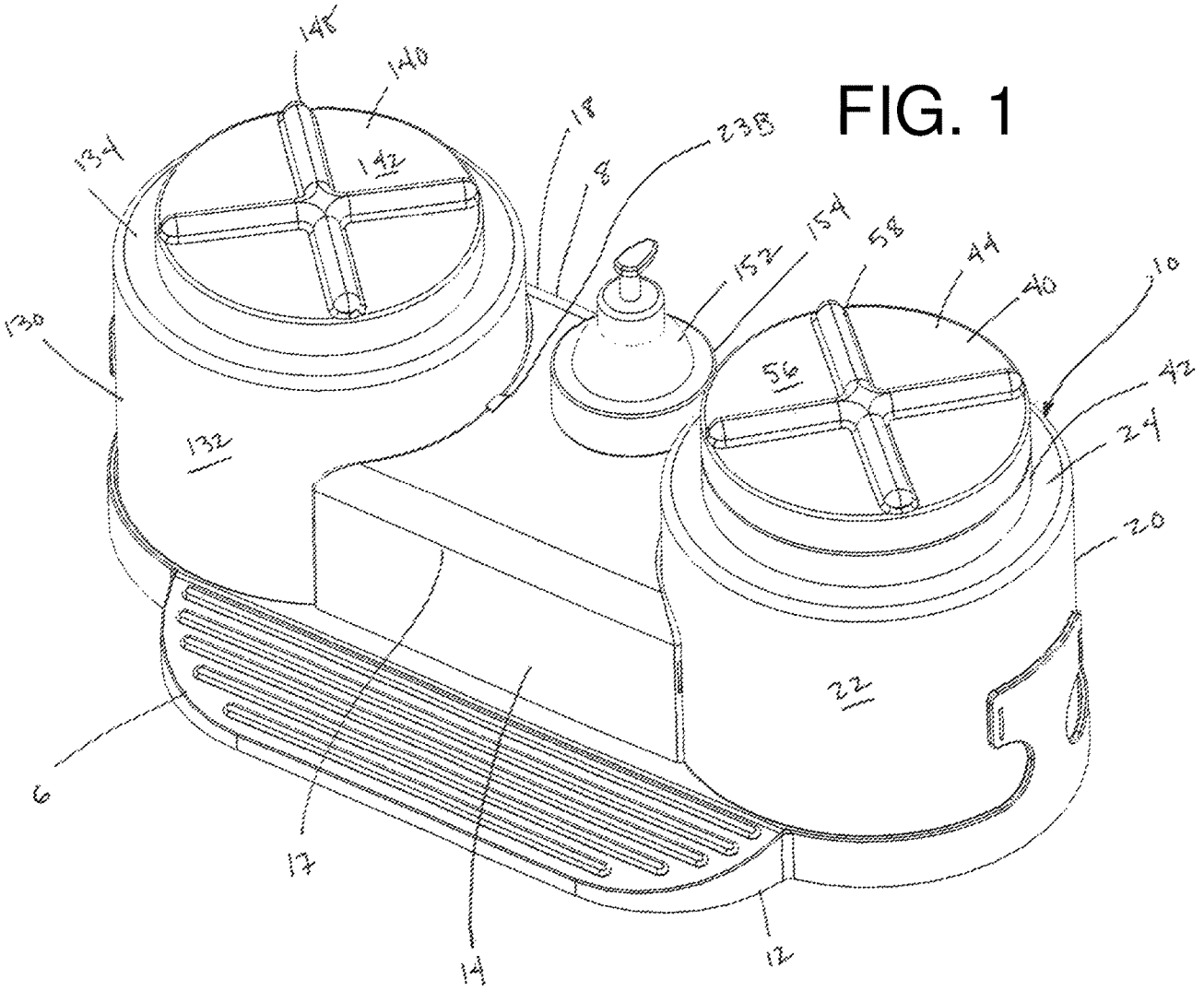
FIG. 1 is a perspective view of an embodiment of a golf club cleaning device according to the invention.

Certain terminology is used in the foregoing description for convenience and is not intended to be limiting. Words such as "front," "back," "top," and "bottom" designate directions in the drawings to which reference is made. This terminology includes the words specifically noted above, derivatives thereof, and words of similar import. Additionally, the words "a" and "one" are defined as including one or more of the referenced item unless specifically noted. The phrase "at least one of" followed by a list of two or more items, such as "A, B or C," means any individual one of A, B or C, as well as any combination thereof.

A first embodiment of a golf club cleaning device 10 is shown in FIGS. 1 to 9. As shown, the device 10 includes a base 12 configured to rest on a surface, such as the ground, and support the device 10. A frame 14 rests on a top surface off the base 12 and supports a cleaning chamber 20, a rinse chamber 130, and a soap housing 150. The device 10 has a front side 6 and a rear side 8, and is oriented in use such that the front side 6 is easily accessible to a player approaching or about to use the device. A front edge 17 extends along the front side 6 and a rear edge 18 extends along the rear side 8.

As shown, the frame 14 extends upward from the base 12 and supports the cleaning chamber 20, rinse chamber 130 and soap housing 150, as described in detail below. In the embodiment shown, the frame 14 includes first and second cutouts 16A, 16B on opposite sides thereof, each extending between the front edge 17 and rear edge 18, with first cutout 16A, being shaped to compliment a portion of the cleaning chamber 20 and the second cutout 16B being shaped to compliment a portion of the rinse chamber 130, allowing the housing 14 to support the chambers in upright positions. In the embodiment shown, the cleaning chamber 20 and rinse chamber 130 each have a cylindrical shape, and the cutouts 16A, 16B have complimentary cylindrical shapes, but the chambers and cutouts could take on other shapes as well. The frame 14 could further include retaining devices, configured to retain the cleaning chamber 20 and rinse chamber 130 in their respective positions within the cutouts 16A, 16B. In the illustrated embodiment, the cutouts 16A, 16B each include a vertically extending groove 23A, 23B, and each chamber 20, 130 includes an axially extending ridge 38A, 38B that engages the groove 23A, 23B to retain the chamber 20, 130 within the cutout 16A, 16B. The ridge 38A, 38B may be formed as a dovetail tenon and the groove as a complimentary dovetail mortise that locks the ridge 38A, 38B within the groove 23A, 23B, for example, allowing removal of the chambers 20, 130 only by sliding out from the cutouts 16A, 16B in an axial direction. In other embodiments, the ridge 38A, 38B and groove 23A, 23B could take on other complimentary shapes, for example, that of a square or rectangle. In yet other embodiments, the ridge 38A, 38B and groove 23A, 23B could be omitted. The frame 14 further defines the soap housing 150, as described in detail below.

Figure 2:
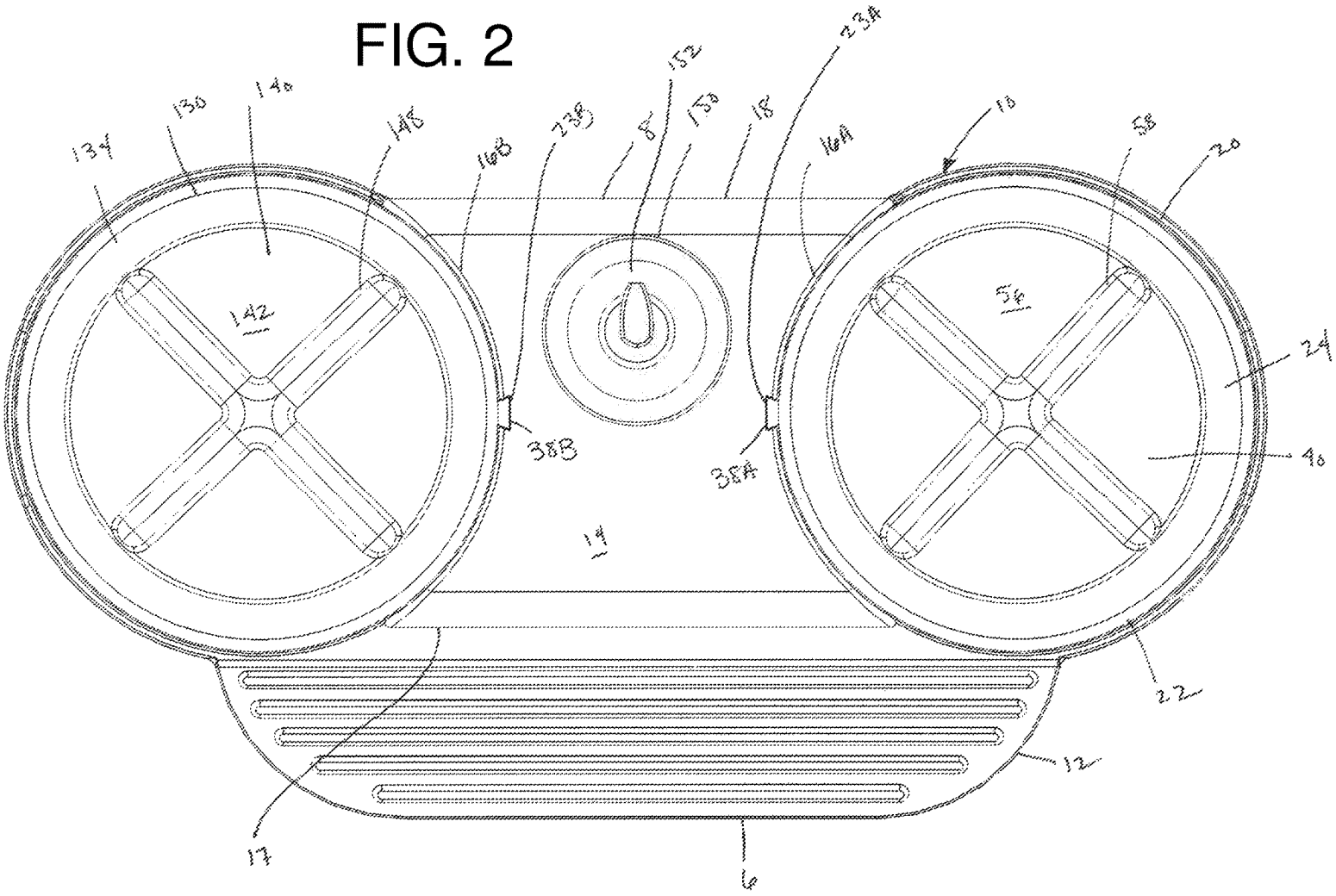
FIG. 2 is a top plan view of the golf club cleaning device of FIG. 1.
Figure 3:
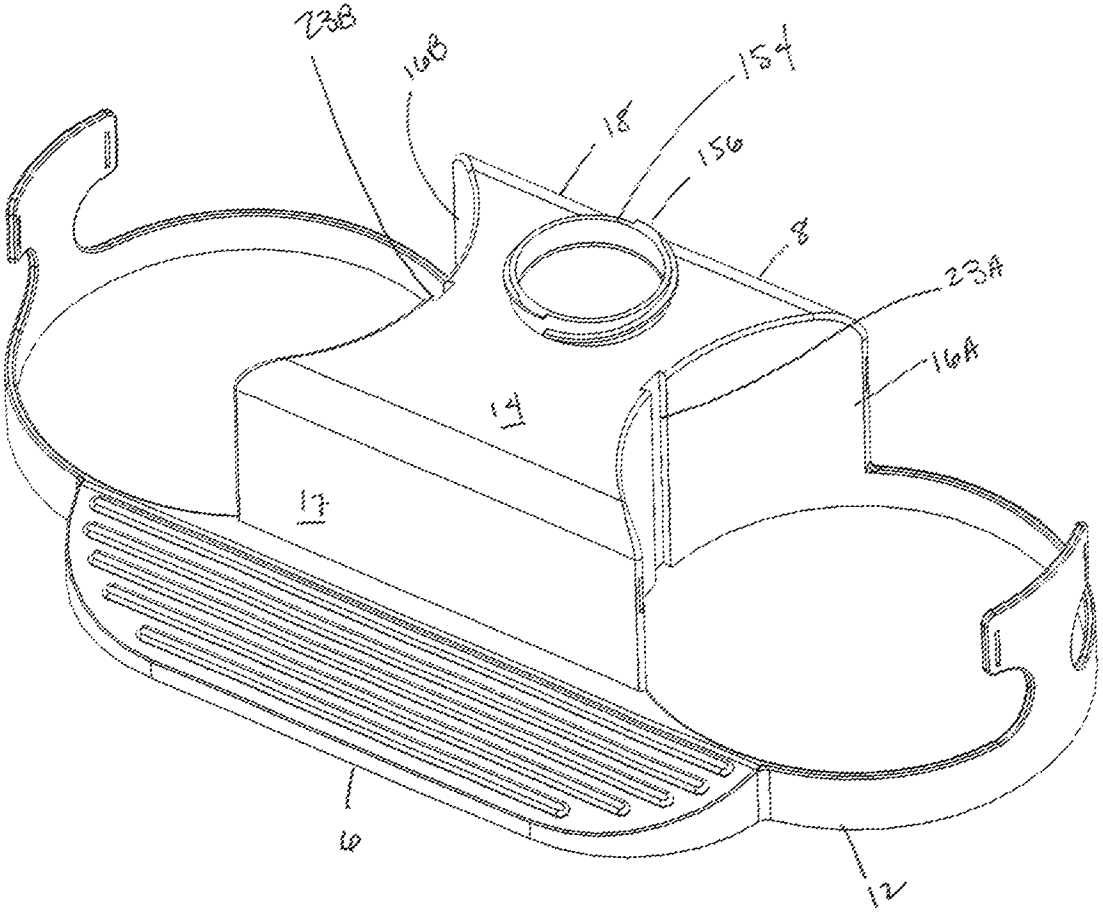
FIG. 3 is a perspective view of the base and frame of the golf club cleaning device of FIG. 1.
Figure 4:
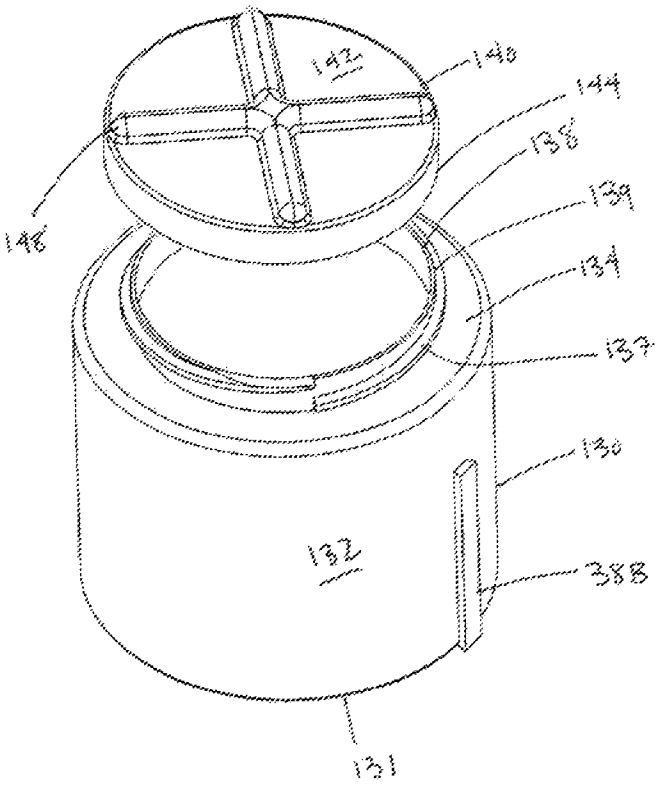
FIG. 4 is an exploded perspective view of the rinse chamber of the cleaning device of FIG. 1.
Figure 5:
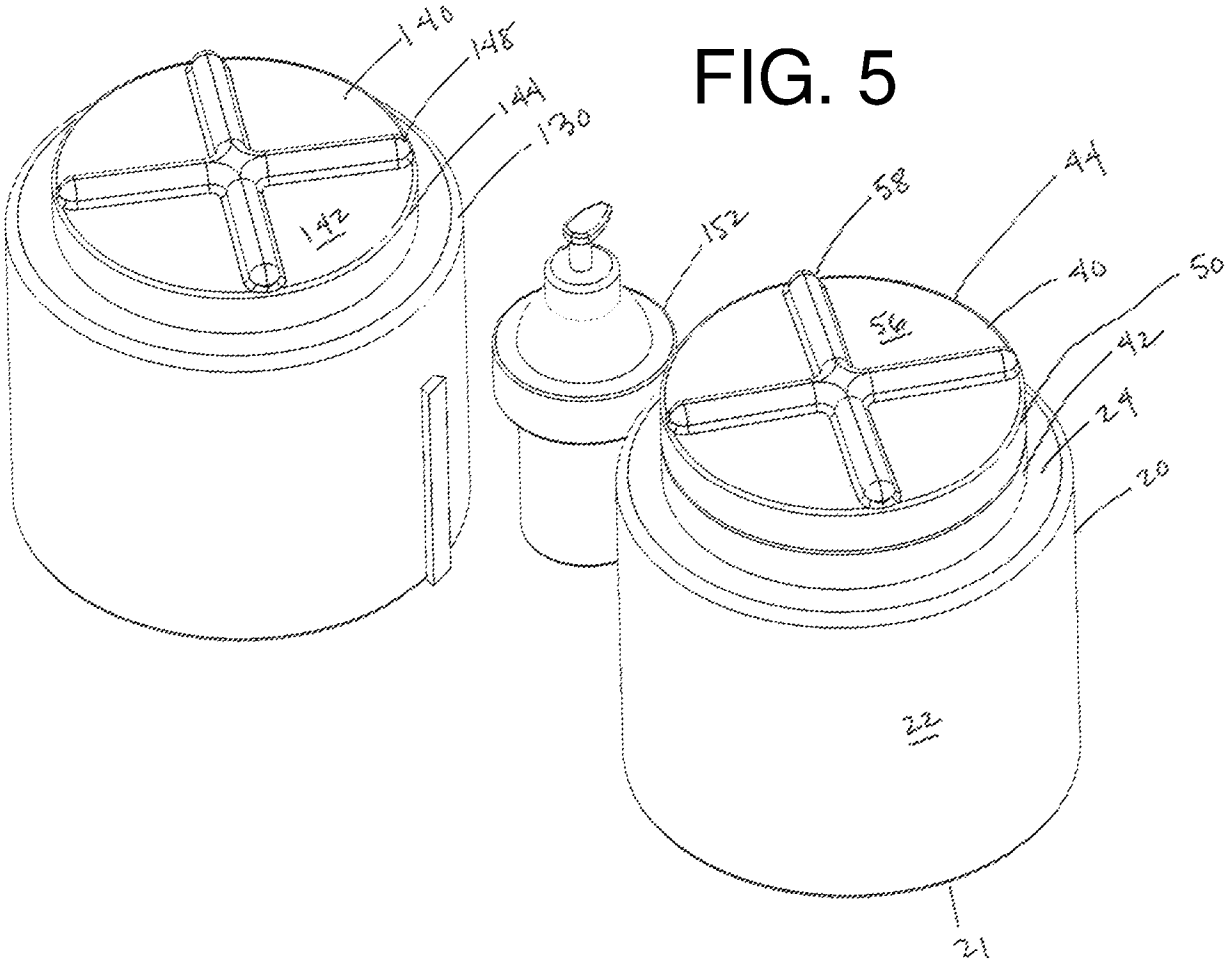
FIG. 5 is a perspective view of the cleaning chamber, rinse chamber and cleaning solution bottle of the golf club cleaning device of FIG. 1.

Referring to FIGS. 1 and 2, the cleaning chamber 20 sits on the base 12 within the first cutout 16A. The cleaning chamber 20 includes a bottom wall 21, a cylindrical side wall 22 that extends upward from bottom wall 21, and a top wall 24. The bottom wall 21, side wall 22 and top wall 24 together define an interior suitable for housing an insert 60, which is described in detail below. The top wall 24 defines an opening 30 leading to the interior, and the cleaning chamber 20 is provided with a lid 40 configured to cover the opening 30, and which moves between an opened position in which the lid 40 is displaced from the opening 30, and a closed position in which the lid 40 is affixed over the opening 30, as shown in FIG. 1.

Figure 8:
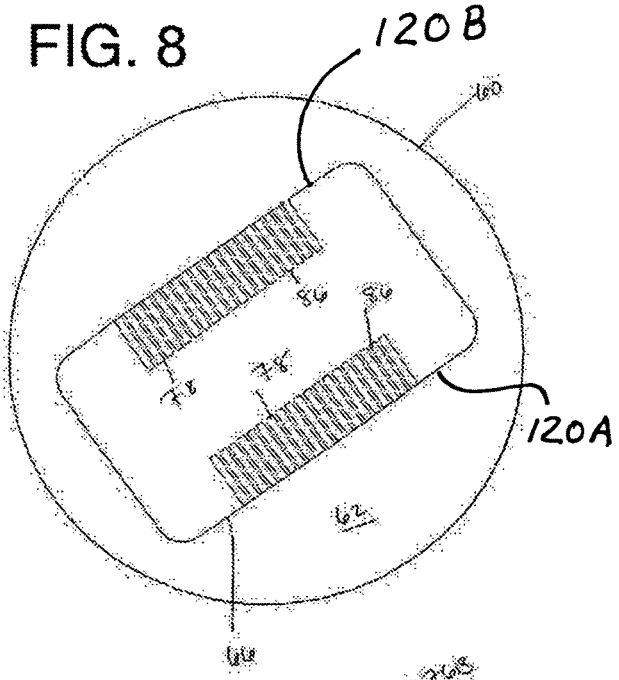
FIG. 8 is a top plan view of the insert of FIG. 7.
Figure 7:
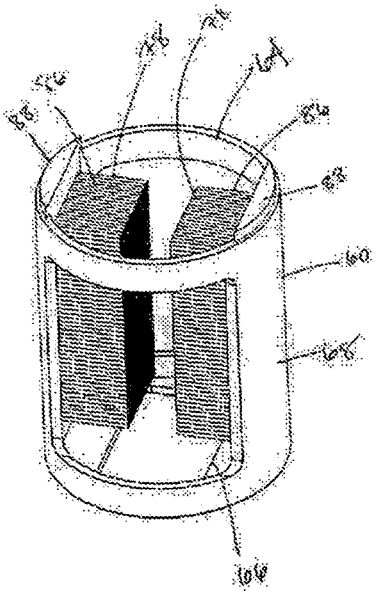
FIG. 7 is an inverted perspective view of the cleaning insert of the golf club cleaning device of FIG. 1.
Figure 9:
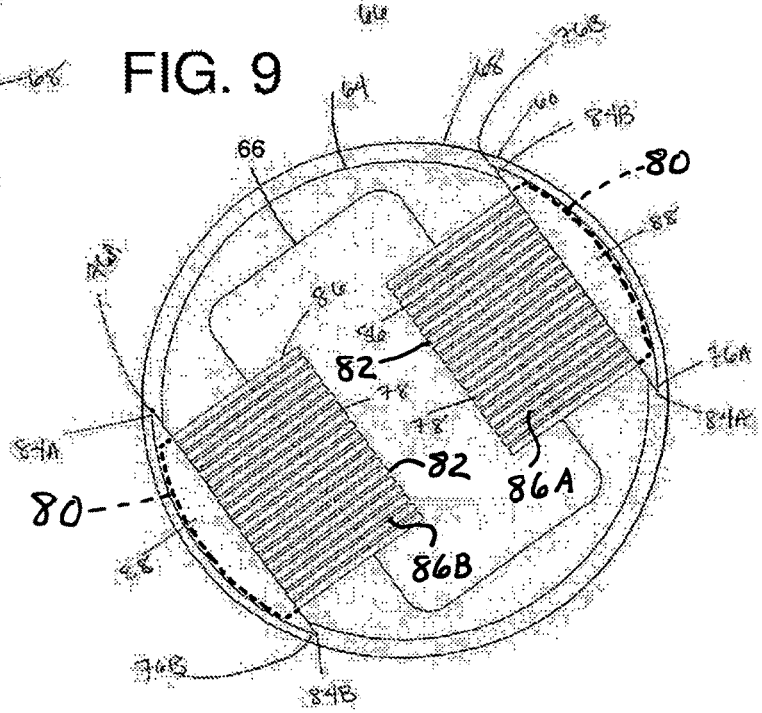
FIG. 9 is a bottom plan view of the insert of FIG. 7.

Referring to FIGS. 7 to 9, the insert 60 will be described in detail. As shown, the insert 60 has a generally cylindrical shape, including top wall 62, an open bottom 64, and a tubular side wall 68 extending between the top wall 62 and the bottom 64. An opening 66, which has a rectangular shape in the embodiment shown, is formed in the top wall 62 to allow for insertion of a golf club head, as described below. The insert 60 is dimensioned to fit within the cleaning chamber 20.

Cleaning materials are affixed on opposing sides of the inner surface of the side wall 68. As used herein, the term "cleaning material" or "cleaning materials" is defined as any material sufficiently abrasive so as to remove dirt and debris from an article by frictional force, yet sufficiently resilient so as to not to cause damage. Examples of cleaning materials includes brushes, rags, sponges, rope and other textile materials. In the embodiment shown, the cleaning materials are textile ropes.

As shown, the cleaning materials 86 of this embodiment are brushes. First and second brushes 86A, 86B extend inward towards each other from opposite sides of the inner surface of side wall 68. The cleaning materials 86 may be removably affixed within the insert 60. In the embodiment shown, each brush includes a base 88 with a plurality of bristles affixed thereto. The base 88 has a curved outer surface 80 complimentary to the inner surface of the tubular side wall 68, and a substantially planar inner surface 82 located opposite the outer surface 80. Bristles 78 extend from inner surface 82. Opposite edges 84A, 84B join the outer surface 80 and inner surface 82. First and second grooves 76A, 76B extend in axial directions along the inner surface of side wall 68. Groove 76A receives edge 84A and groove 76B receives edge 84B to slidably affix the base 88 to an inner surface of the side wall 68. This allows for sliding of the brushes 86 into and out from their respective positions within the insert, for removal, cleaning or replacement. In other embodiments, the use of a separate base 88 could be omitted, and the insert 60 formed as a single, unitary structure with the cleaning materials permanently affixed thereto.

As shown in FIGS. 7 to 9, the brushes 86 are positioned opposite each other, i.e., spaced approximately 180° within the insert, and are aligned lengthwise with opposite long sides 120A, 120B of the rectangular opening 66. Long sides 120A, 120B are displaced from each other by a distance suitable to allow the width W of golf club head to pass therethrough, but not large enough to allow passage of the length L of a golf club head to pass therethrough.

In other embodiments, other cleaning materials, such as abrasive ropes, sponges, or textile fabrics could be employed alone, in combination with each other, or in combination with the brush assemblies shown and described herein.

The insert 60 may be positioned within the cleaning chamber 20 at a fixed position, for example such that the sides of rectangular opening 66 are angled at approximately 45° with respect to the front edge 17 and rear edge.

The cleaning chamber 20 is configured to house a cleaning solution, such as a soap solution, therein. Due to the open construction of the insert 60, such a soap solution fills the interior of the cleaning chamber and that of the insert 60.

The cleaning chamber 20 may optionally be sealed, for example by application of a sealing material to the outer surfaces thereof. In one embodiment, a layer of nylon shrink wrap is applied to the exterior of the vessel as a sealing material. In other embodiments, other sealing materials could be utilized.

Figure 6:
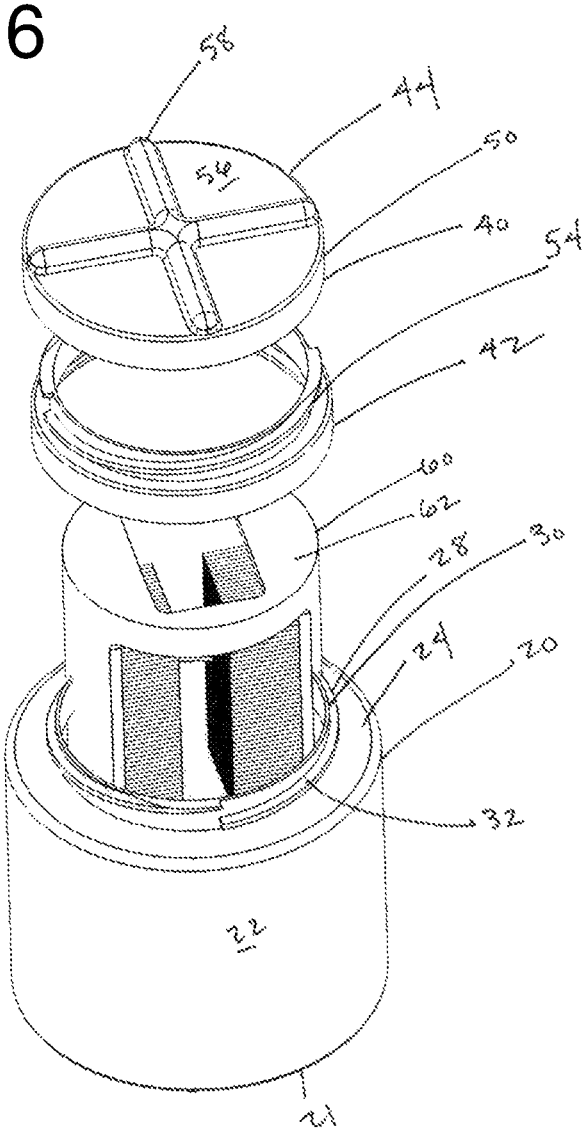
FIG. 6 is an exploded perspective view of the cleaning chamber of the golf club cleaning device of FIG. 1.

The cleaning chamber 20 further includes a lid 40. Referring to FIGS. 1, 2, 5 and 6 a device 10 having a lid 40 according to one embodiment of the invention is shown in detail. As shown, the lid 40 of this embodiment includes a lower ring 42 and an upper cap 44. As shown in FIG. 6, the cleaning chamber top wall 24 includes an opening 30 and upwardly extending lip 28 surrounding the opening 30. Exterior threads 32 are formed on an outer surface of the lip 28. In the embodiment shown, the exterior threads 32 include two half threads, each extending halfway around the circumference of the lip 28. Lower ring 42 includes interior threads, which may also be two half-threads that engage the exterior threads 32 of lip 28, and the lower ring 42 is affixed to the lip 28 by engaging the interior threads thereof with the exterior threads 32 of lip 28. The use of two half threads permits the lower ring 42 to be affixed to the cleaning chamber 20 by turning the lower ring 42 only a half turn with respect to the cleaning chamber 20. Lower ring 42 further includes exterior threads 54 formed thereon, which may also be two half threads that extend halfway about the circumference of lower ring 42, and are used to affix the upper cap 44 thereto, as described in detail below.

Upper cap 44 includes an upper or top wall 56 and a downwardly extending skirt 50 having interior threads formed thereon, which may also be two half threads. The interior threads engage the exterior threads 54 of lower ring 42 to affix the upper cap 44 to the lower ring 42 and cover the opening 30.

The upper or top wall 56 of the upper cap 44 may include in the upper or top wall 56 a substantially planar surface forming a cover for the opening 30, to enclose the cleaning chamber 20. The top wall 56 of the embodiment shown includes an upwardly extending x-shaped ridge 58 formed therein, each of the legs of the ridge 58 having a generally equal extension and being distributed equally, or about 90° apart. The ridge 58 can easily be gripped by a user, to rotate the upper cap 44 with respect to the lower ring 42, to disengage the threads and remove the upper cap 44 to expose the interior of the chamber for washing of a golf club head. Additionally, the legs of the ridge 58 can serve as reference points, indicating the rotational position at which a user should place the upper cap 44 to begin engaging the threads to affix the upper cap 44 to the cleaning chamber 20, as well as the rotational position at which the threads are fully disengaged and the upper cap 44 may be removed from the cleaning chamber 20. For example, placing the upper cap 44 on the cleaning chamber 20 with the legs of the ridge 58 located at approximately 45° angles with respect to the front edge 6 and rear edge 8 of the base 12 may indicate that the threads are at a position where they can be engaged or disengaged. Turning the upper cap 44 so that the legs have rotated 180° degrees may indicate that the threads have been fully engaged or disengaged.

Cleaning chamber top opening 30 is preferably of a diameter slightly larger than that of the insert top wall 62, so that when the entire lid 40 including lower ring 42 is removed from the cleaning chamber 20, the insert 60 can easily be inserted and removed from the interior thereof by passing through opening 30. Lower ring 42 preferably has an inner diameter less than that of the insert top wall 62, so that when the lower ring 42 is affixed to the cleaning chamber 20 with the insert 60 contained therein, the insert 60 is retained within the interior of the cleaning chamber 20, but objects that are dimensioned smaller than the inner diameter of the lower ring 42, such as the heads of golf clubs, can easily pass through the lower ring 42 and opening 66.

The device 10 may further include a rinse chamber 130. Referring to FIGS. 1, 2, 4 and 5, the rinse chamber 130 sits on the base 12 within the second cutout 16B. As shown, the rinse chamber includes a bottom wall 131, cylindrical side wall 132 that extends upward from the bottom wall 131, and a top wall 134. The bottom wall 131, side wall 132 and top wall 134 together define an interior suitable for housing a rinse solution, such as water. The top wall 134 defines an opening 138 leading to the interior, and the rinse chamber 130 is provided with a lid 140 configured to cover the opening 138, and which moves between an opened position in which the lid 140 is displaced from the opening 138, and a closed position in which the lid 140 is affixed over the opening 138.

In the embodiment shown, a lip 139 extends upward from the opening 138, and exterior threads 137 are formed on the lip 139. The threads 137 may be two half-threads, configured similarly to half threads 32. The lid 140 includes a top wall 142 and downwardly extending skirt 144. Interior threads may be formed on an inner surface of the skirt 144 and configured to engage the exterior threads 137 of the lip 139. The use of two half threads permits the lid 140 to be affixed to the rinse chamber 130 by turning the lid 140 only a half turn with respect to the rinse chamber 130.

The lid 140 may further include the top wall 142 having a substantially planar surface and forming a cover for the opening 138, to enclose the interior when the lid 140 is affixed over the opening. The top wall 142 of the embodiment shown includes an upwardly extending x-shaped ridge 148 formed therein, each of the legs of the ridge 148 having a generally equal extension and being distributed equally, or about 90° apart. The ridge 148 can easily be gripped by a user, to rotate the lid 140 with respect to the rinse chamber 130, to disengage the threads and remove the lid 140 to expose the interior of the chamber for rinsing of a golf club head. Additionally, the legs of the ridge 148 can serve as reference points, indicating the rotational position at which a user should place the lid 140 to begin engaging the threads to affix the lid 140 to the rinse chamber 130, as well as the rotational position at which the threads are fully disengaged and the lid 140 may be removed from the rinse chamber 130. For example, placing the lid 140 on the rinse chamber 130 with the legs of the ridge 148 located at approximately 45° angles with respect to the front edge 6 and rear edge 8 of the base 12 may indicate that the threads are at a position where they can be engaged or disengaged. Turning the lid 140 so that the legs have rotated 180° degrees may indicate that the threads have been fully engaged or disengaged.

The device 10 may further include a soap housing 150 configured to house, for example, a bottled cleaning solution, which may be transferred to the cleaning chamber when ready. For example, a concentrated cleaning solution could be stored in the soap housing 150 and mixed with water to create a soap solution suitable for cleaning a golf club head within the cleaning chamber 20. In the illustrated embodiment, the housing 150 is a cavity, configured to house a bottle 152 that stores the cleaning solution. In the embodiment shown, the bottle 152 is a pump dispenser and is removably stored within the housing. The bottle 152 could optionally be configured to engage the soap housing 150. For example, in the embodiment shown, the bottle 152 includes a collar, which may have a tubular shape and an inner thread formed thereon. The housing 150 may include an upwardly extending collar 154 extending about the cavity, with an outer thread 156 formed on the collar, the outer thread 156 configured for engaging the inner thread of the collar 154 to releasably affix the bottle 152 within the cavity.

In order to clean a golf club head 160 using the device, the lid 40 is first removed from the cleaning chamber 20 as described above, to expose the opening 30. The head 160 of a golf club is inserted through the opening 30 and into the cleaning chamber 20. The head 160 passes between long sides 120A, 120B of rectangular opening 66 which, as mentioned above, are distanced to allow the width W of the head to pass therebetween, while preventing the length L from passing therebetween. As a result of this dimensioning, the club head 160 must be inserted with the sides (extending in the lengthwise L direction) facing the cleaning materials 86, ensuring proper orientation of the head 160 relative to the cleaning materials 86. The head 160 may then be agitated, for example by pumping within the cleaning chamber 20, in order to move the head 160 against the cleaning materials 86 and scrub any debris from the head 160. The lid 140 is then removed from the rinse chamber 130 and the head 160 inserted therein through opening 138 to submerge the head 160 in the rinse solution. Lids 40, 140 may then be replaced.

In some embodiments, either of the lids 40, 140 may be configured to sealingly engage the chamber to which they affix, to avoid leaks and allow for easy transportation of the device. In some embodiments, sealing structures may be provided, for example between the lid 40, 140 and the associated opening 30, 138. In other embodiments, the lids 40, 140 form a non-sealing engagement.

The cleaning device 10 of FIGS. 1 to 9 may be compact, and sized, for example, so as to be easily portable or used by individuals, for example in their homes. In other embodiments, the cleaning device may be used at other locations and sized to meet the needs of the specific location.

A second embodiment of a golf club cleaning device 1010 is shown in FIGS. 10 to 15. As shown, the device 1010 includes a substantially planar base 1012 configured to rest on a surface, such as the ground, in order to support the device 1010. A cleaning body 1014 rests on a top surface off the base 1012 and includes a chamber 1020 configured for cleaning the head of a golf club, as described in detail below. The top surface of the base 1012 may include cavities 1016, each cavity 1016 being configured for seating the bottom of a cleaning body 1014 therein. In the embodiment shown, the device 1010 includes two cleaning bodies 1014 seated side by side upon the base 1012. In such an embodiment, one of the cleaning bodies 1014 may be used for washing a golf club head and may be filled with a cleaning solution, such as a soap solution, and the other cleaning body 1014 may be used for rinsing the golf club head after washing and may be filled with a rinsing solution, such as water. In other embodiments, the device 1010 could include a single cleaning body 1014, or more than two cleaning bodies 1014. More than two cleaning bodies 1014 may be provided, for example, where the device is used at a high traffic golf course, so as to permit many players to clean their clubs simultaneously. In the embodiment shown, the two cleaning bodies 1014 are configured similarly, and only one of the cleaning bodies will be described in detail.

The chamber 1020 has a generally rectangular shape formed of a front wall 1022, rear wall 1024, and first and second side walls 1026, 1028, each of which extends upward from a bottom wall 1029 that rests on the top surface of the base 1012. An interior 1030 is defined within the chamber 1020 and is closed off by a top wall 1050 of the chamber 1020. The interior houses at least one cleaning device, as described in detail below, and a cleaning solution or rinsing solution. The top wall 1050 is releasably affixed over the top of the chamber 1020. The top wall 1050 defines an opening 1052 that allows for insertion of a golf club head for cleaning or rinsing. A removable cap 1070 is affixed over the opening.

The top wall 1050 is shown in detail in FIGS. 10 to 12A. As shown, the top wall extends horizontally over top of the chamber 1020 to close off the interior 1030. In the embodiment shown, the top wall 1050 includes outer edges 1054 that are located outward of the chamber walls 1022, 1024, 1026, 1028, forming an overhang, and a sloped border 1056 located adjacent to the edges 1022, 1024, 1026, 1028, surrounding the top wall 1050. The sloped border 1056 may include a sloped surface 1058 that angles downward and outward with respect to the center of the top wall 1050. When a golf club is cleaned using the device, it may drip cleaning or rinsing solution onto the top wall 1050 upon removal from the chamber 1020. The solution will disperse and run down the sloped surface 1058 of the sloped border 1056, it will then drip downwards, avoiding contact with the chamber walls 1022, 1024, 1026, 1028 due to the edges 1054 of top wall being located outward thereof. The cleaning solution may land on the base 1012, which may include a plurality of holes 1016, allowing the dripped cleaning solution to pass therethrough to avoid pooling.

Figure 10:
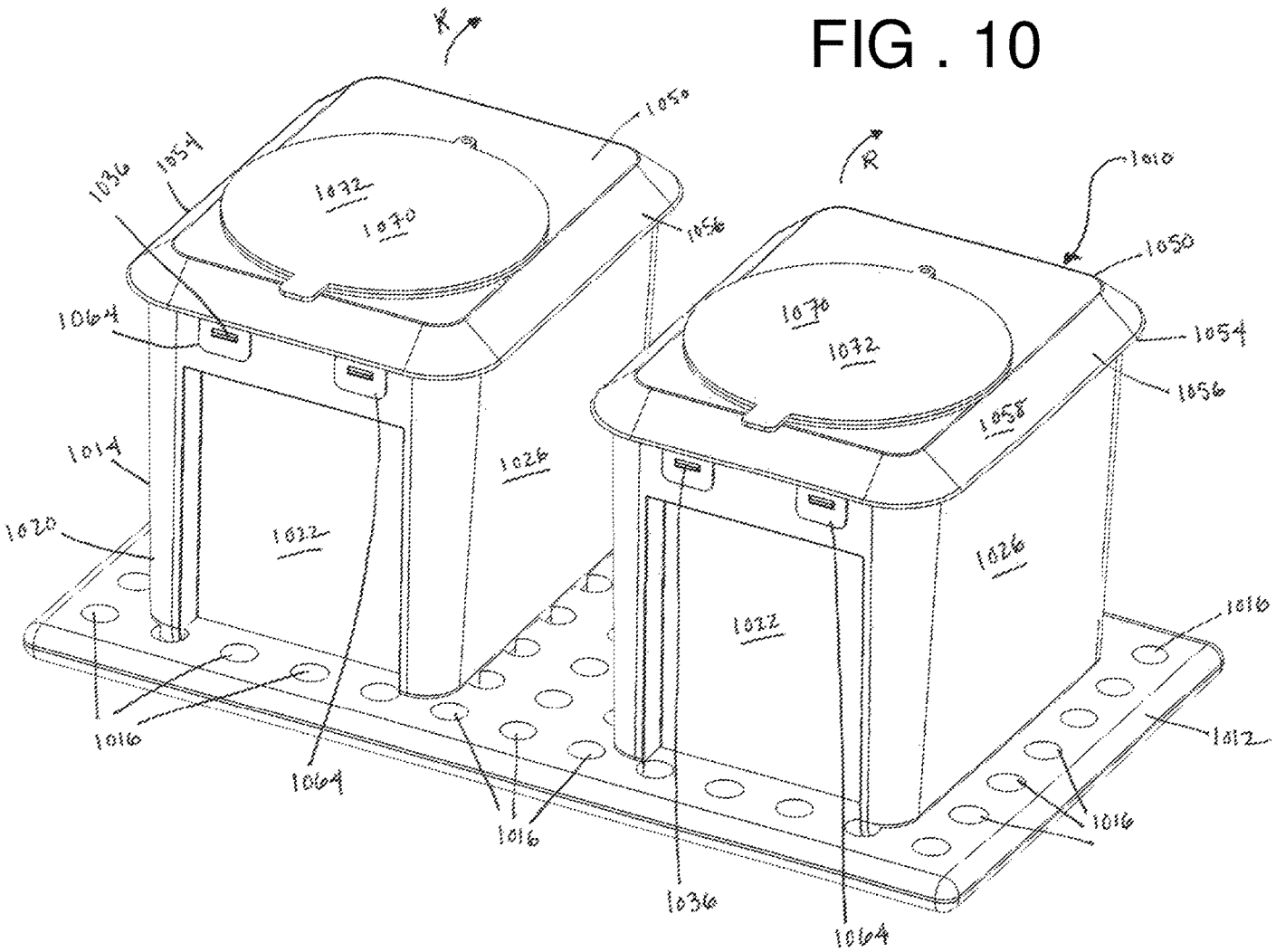
FIG. 10 is a perspective view of another embodiment of a golf club cleaning device according to the invention.
Figure 11:
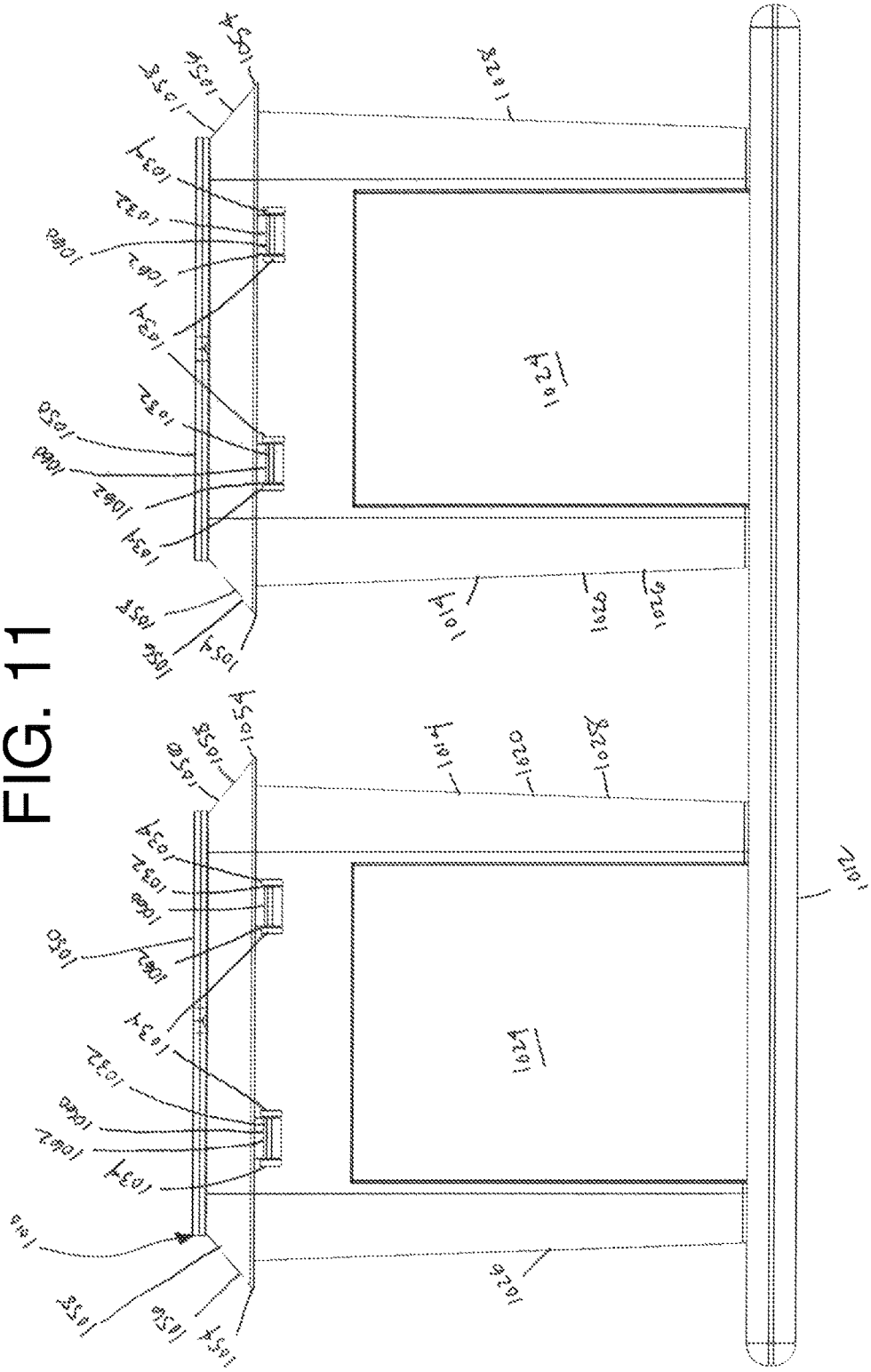
FIG. 11 is a rear elevational view of the golf club cleaning device of FIG. 10

The top wall 1050 may be releasably affixed over the chamber 1020, to allow for removal and replacement therefrom, for example for adding, removing and changing the cleaning or rinsing solution housed therein. In the embodiment shown, the top wall 1050 is pivotally affixed over the chamber 1020 by a hinge 1060. In the embodiment shown, the hinge 1060 is located at the rear of the cleaning body 1014 and affixes the edge 1054 of top wall 1050 to an upper edge of the rear chamber wall 1024, allowing the top wall 1050 to pivot in direction R to move between an opened position in which the interior 1030 is exposed and a closed position in which the top wall 1050 covers the interior, as shown in FIG. 10. Any suitable type of mechanical hinge known in the art could be employed. In the illustrated embodiment, the top wall 1050 includes sleeves 1062 attached to the top wall 1050, in particular attached to a bottom surface thereof, adjacent to the edge 1054. The rear wall 1024 of the chamber 1020 includes a pin 1032 associated with each sleeve 1062, and each pin may be affixed to the rear wall 1024 by first and second tabs 1034 extending outward from the rear wall 1024, with the pin 1032 extending between the pair of tabs 1034. In the illustrated embodiment, two sleeves 1062 are provided, each having an associated pin 1032, however, more or fewer sleeves 1062 and associated pins 1032 could be provided, depending on the size and stability requirements of the device 1010. Each pin 1032 rotates within its respective sleeve 1062, allowing for pivoting of the top wall 1050 with respect to the chamber 1020.

The chamber 1020 may further include a releasable locking mechanism to lock the top wall in the closed position. In the illustrated embodiment, the chamber includes releasable catches 1064. As shown, each catch 1064 is formed as a flange extending downward from a bottom surface of the top wall 1050, on the front side of the cleaning body 1014 and adjacent to the edge 1054 of the top wall. Each catch 1064 includes an opening 1066 configured to receive a protrusion 1036 extending outward from the front wall 1022 when the top wall 1050 is in the closed position. The catches 1064 may be formed of a semi-rigid material, allowing flexion to move over the protrusions 1036 allowing entry into and removal from the openings 1066 to engage and disengage the catches 1064 from the chamber 1020 in a snapping engagement. In the illustrated embodiment, two catches 1064 are provided, each having an associated protrusion 1036. In other embodiments, fewer or more catches 1064 and associated protrusions 1036 could be provided, depending on the size and stability requirements of the device 1010.

The opening 1052 is positioned and dimensioned to allow for easy insertion of a golf club head therethrough. In the embodiment shown, the opening 1052 is positioned closer to the front wall 1022 of the chamber, so as to allow insertion of the lower end of a golf club through the opening at an angle extending from the upper front side of the device 1010 towards the lower rear side of the device 1010, which may be convenient for players standing in front of the device and facing the front side thereof.

Figure 12:
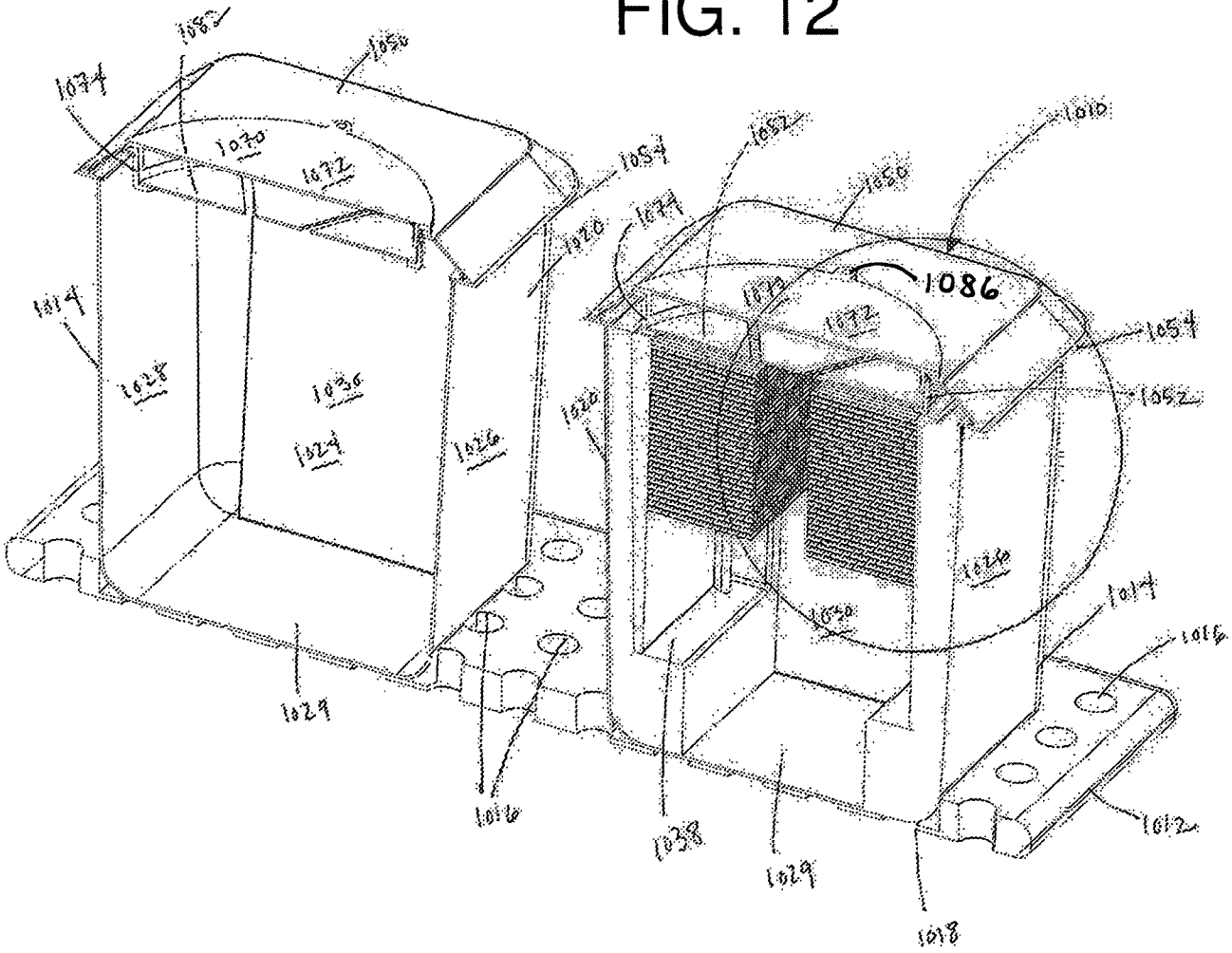
FIG. 12 is a perspective cut away view of the golf club cleaning device of FIG. 10.
Figure 12A:
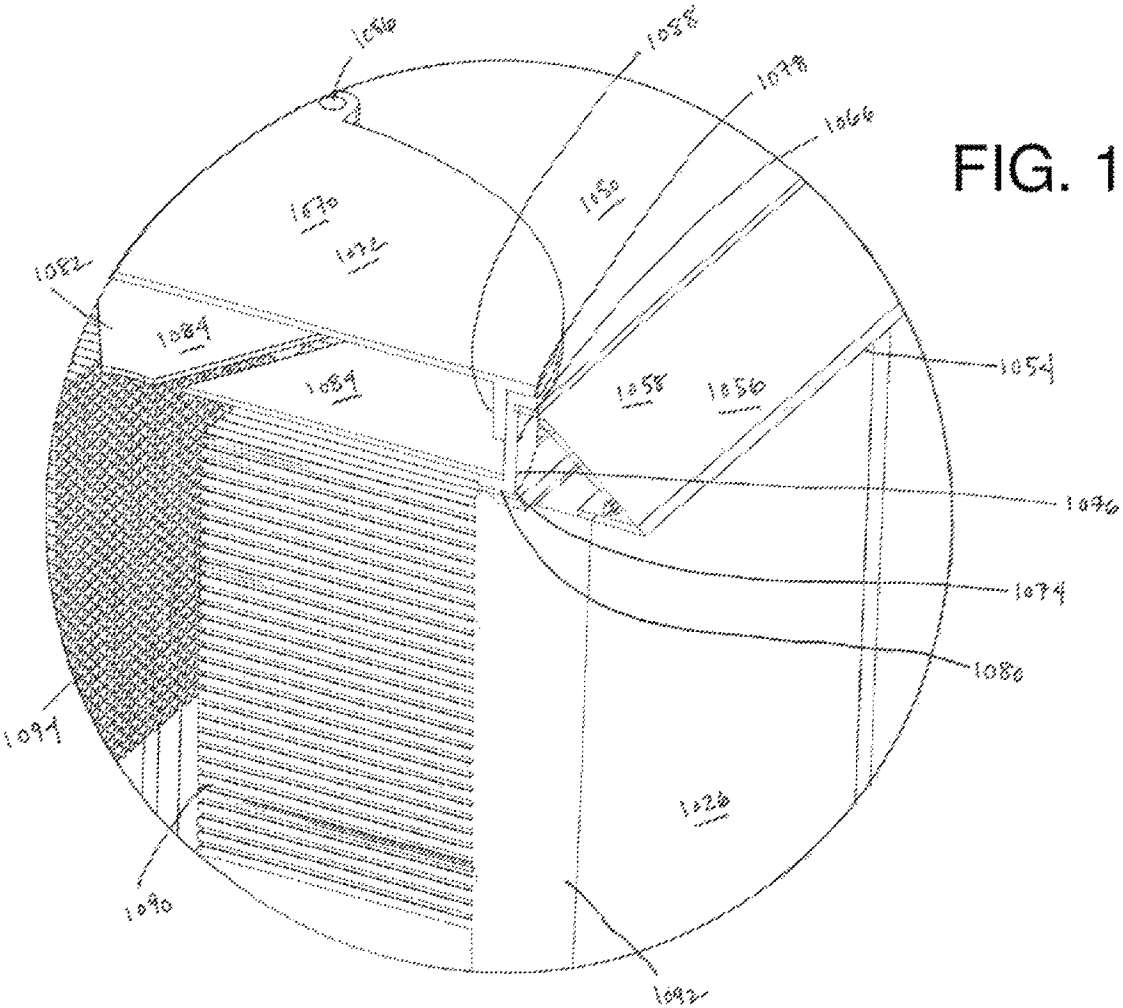
FIG. 12A is an enlarged detail of FIG. 12.
Figure 14:
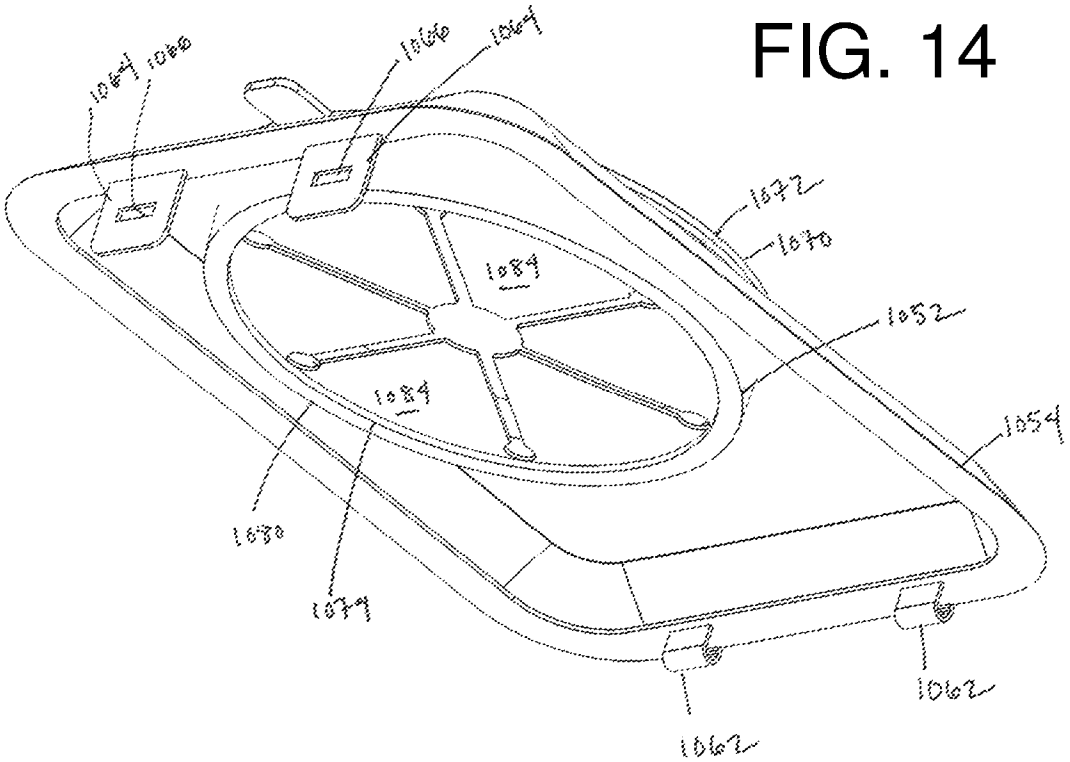
FIG. 14 is a bottom perspective view of a top wall and cap of the golf club cleaning device of FIG. 10.
Figure 15:
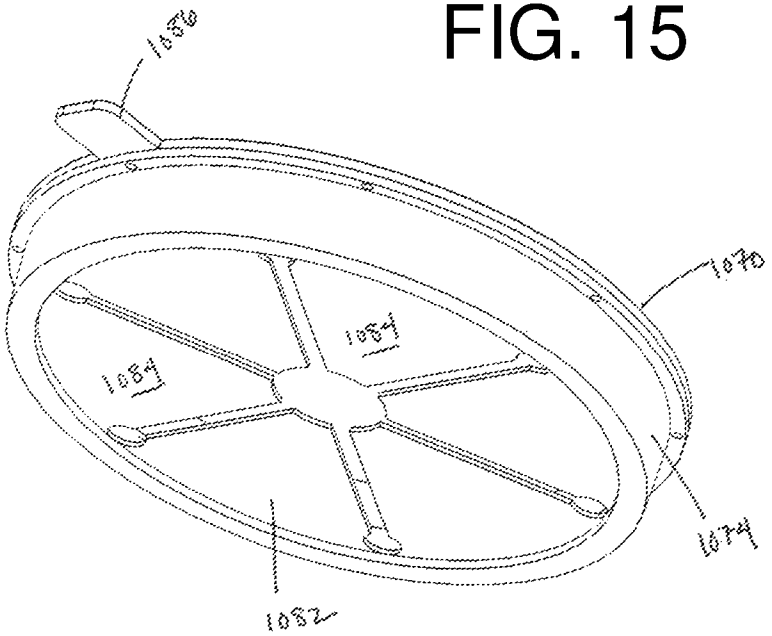
FIG. 15 is a bottom perspective view of the cap of FIG. 13.
Figure 16:
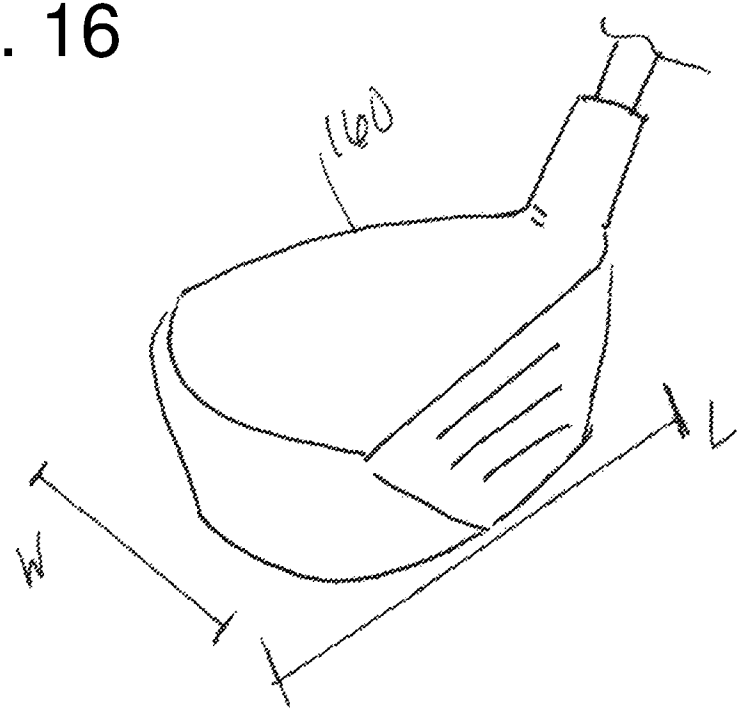
FIG. 16 is a perspective view of a golf club head.

As shown in FIGS. 12 and 12A, the opening 1052 includes an inner ring 1074. The inner ring 1074 has a tubular wall 1076 that extends through the opening 1052. The outer diameter of the tubular wall 1076 may be approximately equal to the inner diameter or the opening 1052, so as to allow for engagement of the inner ring 1074 with the opening in an interference fit. An upper collar 1078 extends radially outward from an upper end of the tubular wall 1076, and a lower lip 1080 extends radially inward from a lower end of the tubular wall 1076. Referring to FIG. 12A, the upper collar 1078 sits on an upper surface of the top wall 1050 and portions of the lower lip 1080 may sit above upper edges of brush plates 1092, which shall be described in detail below. In some embodiments, the inner ring 1074 may be affixed within the opening 1052 by fasteners, for example, a plurality of mechanical fasteners, such as screws, may pass through aligned openings formed in the upper collar 1078 and top wall 1050 to affix the inner ring 1074 within the opening 1052.

The inner ring 1074 may further include a splash guard 1082. The splash guard 1082 may be formed as a plurality of flaps 1084 that extend inward towards the center of the opening 1052. The flaps 1084 are preferably formed of a material having a sufficient rigidity so as to permit the flaps 1084 to extend in a horizontal, planar configuration under normal circumstances, but also having sufficient flexibility so as to allow deformation, so the flaps 1084 can easily be displaced by a golf club passing through the opening 1052. In some embodiments, the flaps 1084 are formed of an elastomeric material, such as silicone rubber. The splash guard is located within the central opening of the ring 1074, extending within the tubular wall 1076, with an outer edge thereof seated above the lower lip 1080, as shown in FIG. 12A.

The opening 1052 is covered by the cap 1070 which moves between an opened position, in which the cap 1070 is displaced from the opening 1052 to allow insertion of a golf club head, and a closed position in which the cap 1070 covers the opening 1052.

The cap 1070 includes a substantially planar upper cover 1072 and a downwardly extending skirt 1088. The cover 1072 is dimensioned to fully cover the opening 1052 when the cap 1070 is in the closed position. In the embodiment shown, both the opening 1052 and cover 1072 are round. Skirt 1088 is formed as a cylindrical wall that extends downward from a bottom surface of the cover 1072. The skirt 1088 may have an outer diameter approximately equal to the inner diameter of the inner ring 1074, so as to permit engagement of the cap 1070 with the inner ring 1074 and in turn the opening 1052 in an interference fit when the cap 1070 is in the closed position. The cap 1070 may optionally be affixed to the chamber 1020 by a hinge 1086. In the embodiment shown, the cap 1070 includes a flexible tab affixed to the top wall 1050, for example by a mechanical fastener 1086 such as a screw, to pivotally affix the cap 1070 over the opening 1052. The cap 1070 can then be pivoted in direction R to move between the opened and closed positions. In other embodiments, the cap 1070 could be fully detachable from the chamber 1020. In yet other embodiments, the cap 1070 could be affixed to the chamber 1020 by a tether.

In some embodiments the cap 1070 may be configured to sealingly engage the chamber 1020 to avoid leaks. In some embodiments, sealing structures may be provided, for example between the lid 1070 and inner ring 1074. In other embodiments, the lid 1070 could form a non-sealing engagement.

The opening 1052, and in turn the cap 1070 is dimensioned so as to allow easy passage of a golf club head therethrough, without being excessively large so as to cause undue splashing of cleaning or rinsing solution. The opening 1052 and cap 1070 could be, for example, around 8 inches in diameter.

Referring to FIGS. 12, 12A and 13, at least one cleaning device is affixed within the interior or the chamber 1020. In the embodiment shown, the at least one cleaning device is a plurality of brush assemblies 1090. Each brush assembly 1090 includes a brush plate 1092 and a brush material 1094 affixed thereon. In the illustrated embodiment, each chamber 1020 includes first and second brush assemblies 1090, a first brush assembly being positioned along the first side wall 1026 and a second brush assembly being positioned along the second side wall 1028. As shown, each brush plate 1092 extends vertically, adjacent to the associated side wall 1026, 1028. A bottom edge of each brush plate 1092 may rest on a lower surface of the chamber 1020, or, as in the embodiment shown, upon a ledge 1038 extending inward from an inner surface of the side wall 1026, 1028. Each brush plate 1092 may be retained in place by a pair of tabs 1096 extending inwardly from the adjacent front and rear corners of the chamber 1020. Brush material 1094 extends inward from each brush plate 1092, towards a central region of the interior 1030. The brush material 1094 can be any suitable bristled material known in the art, such as synthetic bristles or animal hair bristles. In other embodiments, other cleaning materials could be provided in place of the brush material, such as a foam or cloth material.

The chamber 1020 is configured to house a cleaning or rinsing solution therein, and may optionally be sealed, for example by application of a sealing material to the inner surfaces of the chamber 1020.

In order to use the device 1010, each chamber 1020 would be opened by pivoting the top wall 1050 thereof about the hinge 1060 to expose the interior 1030. The chamber 1020 would then be filled with either a cleaning solution, such as a soap solution or a rinsing solution, such as water. A first chamber could be filled with a cleaning solution and designated as a "cleaning chamber." The other chamber could be filled with a rinsing solution, such as water and designated as the "rinsing chamber." The top wall 1050 of each chamber is then replaced thereon and affixed in the closed position by engaging catches 1064 with protrusions 1036.

A golf club head could then be cleaned using the device 1010 by first removing the cap 1070 from over the opening 1052 of the cleaning chamber. The club head could be inserted through the opening 1052 and into the cleaning solution contained within the interior 1030. While inside the chamber 1020, the club head will make contact with the brush material 1094, and the brush material in combination with the cleaning solution will help to scrub and remove any debris from the golf club head. Optionally, the golf club head could be agitated while inside the chamber, to facilitate this process. The golf club could then be rinsed using the rinsing chamber in a similar fashion, by first removing the cap and then inserting the club head into the opening 1052 to make contact with the brush material and rinsing solution contained therein. The caps 1070 can be replaced over the openings 1052 upon completion of cleaning and rinsing of the club head.

The cleaning device 1010 of FIGS. 10 to 15 may be sufficiently sized, for example, so as to be used in public settings, where many players will use the device and as such, a large volume of cleaning and rinsing solutions will be required. In other embodiments, the cleaning device may be used at other locations and sized to meet the needs of the specific location.

While the preferred embodiments of the invention have been described in detail above, the invention is not limited to the specific embodiments described, which should be considered as merely exemplary.

What is claimed is:

1. A golf club head cleaning apparatus, comprising a base, a first cleaning body having a bottom wall, a front wall, a back wall, and a pair of side walls, the bottom wall having an outer periphery, the front wall, the back wall, and the pair of side walls extending upwardly from the bottom wall along the outer periphery of the bottom wall, the front wall being connected to the back wall by the pair of side walls and the bottom wall, and the front wall, the back wall, the side walls, and the bottom wall forming a chamber therebetween, the front wall, the back wall, and the side walls of the first cleaning body each having an upper end portion defining an upper end portion of the first cleaning body, the first cleaning body having a top wall removably mounted to the upper end portion of the first cleaning body to close off the chamber of the first cleaning body, the top wall of the first cleaning body having opening means formed therein for allowing passage of a golf club head therethrough and into the chamber of the first cleaning body, cleaning means positioned in the chamber of the first cleaning body for cleaning a golf club head, a second cleaning body having a bottom wall, a front wall, a back wall, and a pair of side walls, the bottom wall having an outer periphery, the front wall, the back wall, and the pair of side walls extending upwardly from the bottom wall along the outer periphery of the bottom wall, the front wall being connected to the back wall by the pair of side walls and the bottom wall, and the front wall, the back wall, the side walls, and the bottom wall forming a chamber therebetween, the front wall, the back wall, and the side walls of the second cleaning body each having an upper end portion defining an upper end portion of the second cleaning body, the second cleaning body having a top wall removably mounted to the upper end portion of the second cleaning body to close off the chamber of the second cleaning body, the top wall of the second cleaning body having opening means formed therein for allowing passage of a golf club head therethrough and into the chamber of the second cleaning body, cleaning means positioned in the chamber of the second cleaning body for cleaning a golf club head, the first cleaning body being releasably mountable onto the base, the second cleaning body being releasably mountable onto the base, and the first cleaning body, the second cleaning body, and the base being separable from one another.

2. The golf club head cleaning apparatus of claim 1, further including a soap solution positioned in the chamber of the first cleaning body, and a rinsing solution positioned in the chamber of the second cleaning body.

3. The golf club head cleaning apparatus of claim 1, further including a first removable cap that may be moved between a closed position in which the first cap is affixed over the opening means formed in the top wall of the first cleaning body to close the opening means in the top wall of the first cleaning body and an opened position in which the first cap may be removed from the opening means formed in the top wall of the first cleaning body to allow for passage of a golf club head through the opening means in the top wall of the first cleaning body and into the chamber of the first cleaning body, and a second removable cap that may be moved between a closed position in which the second cap is affixed over the opening means formed in the top wall of the second cleaning body to close the opening means in the top wall of the second cleaning body and an opened position in which the second cap may be removed from the opening means formed in the top wall of the second cleaning body to allow for passage of a golf club head through the opening means in the top wall of the second cleaning body and into the chamber of the second cleaning body.

4. The golf club head cleaning apparatus of claim 1, the opening means in the top wall of the first cleaning body and the opening means in the top wall of the second cleaning body each having a center point, the opening means in the top wall of the first cleaning body being positioned in the top wall of the first cleaning body near the front wall of the first cleaning body when the top wall of the first cleaning body is mounted on the first cleaning body, with the center point of the opening means in the top wall of the first cleaning body being closer to the front wall of the first cleaning body than the back wall of the first cleaning body, to allow insertion of a golf club head into the chamber of the first cleaning body at an angle extending from an upper front side of the golf club head cleaning apparatus towards a lower rear side of the golf club head cleaning apparatus, and the opening means in the top wall of the second cleaning body being positioned in the top wall of the second cleaning body near the front wall of the second cleaning body when the top wall of the second cleaning body is mounted on the second cleaning body, with the center point of the opening means in the top wall of the second cleaning body being closer to the front wall of the second cleaning body than the back wall of the second cleaning body, to allow insertion of a golf club head into the chamber of the second cleaning body at an angle extending from an upper front side of the golf club head cleaning apparatus towards a lower rear side of the golf club head cleaning apparatus.

5. The golf club head cleaning apparatus of claim 1, the opening means formed in the top wall of the first and second cleaning bodies being 8 inches in diameter.

6. The golf club head cleaning apparatus of claim 1, further including a splash guard extending over the opening means in the top wall of the first cleaning body but permitting a golf club head to pass through the opening means in the top wall of the first cleaning body, and a splash guard extending over the opening means in the top wall of the second cleaning body but permitting a golf club head to pass through the opening means in the top wall of the second cleaning body.

7. The golf club head cleaning apparatus of claim 1, the base having drainage holes extending through the base which are not covered by either the first cleaning body or the second cleaning body when the first cleaning body and the second cleaning body are mounted on the base.

8. The golf club head cleaning apparatus of claim 1, the cleaning means in each of the first and second cleaning bodies comprising a plurality of brushes.

9. The golf club head cleaning apparatus of claim 1, the cleaning means positioned in the chamber of the first cleaning body being removable from the chamber of the first cleaning body after removal of the removable top wall from the upper end portion of the first cleaning body, and the cleaning means positioned in the chamber of the second cleaning body being removable from the chamber of the second cleaning body after removal of the removable top wall from the upper end portion of the second cleaning body.

10. A golf club head cleaning apparatus, comprising a base, a first cleaning body having a bottom wall, a front wall, a back wall, and a pair of side walls, the bottom wall having an outer periphery, the front wall, the back wall, and the pair of side walls extending upwardly from the bottom wall along the outer periphery of the bottom wall, the front wall being connected to the back wall by the pair of side walls and the bottom wall, and the front wall, the back wall, the side walls, and the bottom wall forming a chamber therebetween, the front wall, the back wall, and the side walls of the first cleaning body each having an upper end portion which define an opening into the chamber of the first cleaning body, the opening into the chamber of the first cleaning body being sized to allow for passage of a golf club head therethrough, at least one cleaning device positioned in the chamber of the first cleaning body, a second cleaning body having a bottom wall, a front wall, a back wall, and a pair of side walls, the bottom wall having an outer periphery, the front wall, the back wall, and the pair of side walls extending upwardly from the bottom wall along the outer periphery of the bottom wall, the front wall being connected to the back wall by the pair of side walls and the bottom wall, and the front wall, the back wall, the side walls, and the bottom wall forming a chamber therebetween, the front wall, the back wall, and the side walls of the second cleaning body each having an upper end portion which define an opening into the chamber of the second cleaning body, the opening into the chamber of the second cleaning body being sized to allow for passage of a golf club head therethrough, at least one cleaning device positioned in the chamber of the second cleaning body, the first cleaning body being releasably mountable onto the base, the second cleaning body being releasably mountable onto the base, and the first cleaning body, the second cleaning body, and the base being separable from one another, and further including at least one additional cleaning body, each at least one additional cleaning body having a bottom wall, a front wall, a back wall, and a pair of side walls, the bottom wall having an outer periphery, the front wall, the back wall, and the pair of side walls extending upwardly from the bottom wall along the outer periphery of the bottom wall, the front wall being connected to the back wall by the pair of side walls and the bottom wall, and the front wall, the back wall, the side walls, and the bottom wall forming a chamber therebetween, the front wall, the back wall, and the side walls of each at least one additional cleaning body having an upper end portion which define an opening into the chamber of each at least one additional cleaning body, each at least one additional cleaning body having at least one cleaning device positioned therein, each at least one additional cleaning body being releasably mountable onto the base, and the first cleaning body, the second cleaning body, each at least one additional cleaning body, and the base being separable from one another.

11. A golf club head cleaning apparatus, comprising a base, a first cleaning body having a bottom wall, a front wall, a back wall, and a pair of side walls, the bottom wall having an outer periphery, the front wall, the back wall, and the pair of side walls extending upwardly from the bottom wall along the outer periphery of the bottom wall, the front wall being connected to the back wall by the pair of side walls and the bottom wall, and the front wall, the back wall, the side walls, and the bottom wall forming a chamber therebetween, the front wall, the back wall, and the side walls of the first cleaning body each having an upper end portion which define an opening into the chamber of the first cleaning body, the opening into the chamber of the first cleaning body being sized to allow for passage of a golf club head therethrough, at least one cleaning device positioned in the chamber of the first cleaning body, a second cleaning body having a bottom wall, a front wall, a back wall, and a pair of side walls, the bottom wall having an outer periphery, the front wall, the back wall, and the pair of side walls extending upwardly from the bottom wall along the outer periphery of the bottom wall, the front wall being connected to the back wall by the pair of side walls and the bottom wall, and the front wall, the back wall, the side walls, and the bottom wall forming a chamber therebetween, the front wall, the back wall, and the side walls of the second cleaning body each having an upper end portion which define an opening into the chamber of the second cleaning body, the opening into the chamber of the second cleaning body being sized to allow for passage of a golf club head therethrough, at least one cleaning device positioned in the chamber of the second cleaning body, the first cleaning body being releasably mountable onto the base, the second cleaning body being releasably mountable onto the base, and the first cleaning body, the second cleaning body, and the base being separable from one another, and further including a top wall removably mounted to the first cleaning body to close off the chamber of the first cleaning body, the top wall of the first cleaning body having an opening formed therein, the opening in the top wall of the first cleaning body being dimensioned to allow easy passage of a golf club head therethrough, and a removable cap that may be moved between a closed position in which the cap is affixed over the opening formed in the top wall of the first cleaning body to close the opening in the top wall of the first cleaning body and an opened position in which the cap may be removed from the opening formed in the top wall of the first cleaning body to allow for passage of a golf club head through the opening in the top wall of the first cleaning body and into the chamber of the first cleaning body, the top wall of the first cleaning body having a sloped border portion that angles downwardly and outwardly forming an overhang that extends beyond the front, back, and side walls of the first cleaning body.

12. A golf club head cleaning apparatus, comprising a cleaning chamber having an interior for housing a cleaning solution and opening means formed in a top wall disposed on the cleaning chamber for allowing passage of a golf club head therethrough and into the interior of the cleaning chamber, a rinse chamber having an interior for housing a rinsing solution and opening means formed in a top wall disposed on the rinse chamber for allowing passage of a golf club head therethrough and into the interior of the rinse chamber, and a base, the cleaning chamber having cleaning means positioned therein for cleaning a golf club head, the cleaning means including brushes, rags, sponges, rope, or textile materials, the cleaning chamber being releasably positioned on the base, the rinse chamber being releasably positioned on the base, and the cleaning chamber, the rinse chamber, and the base being separable from one another.

13. The golf club head cleaning apparatus of claim 12, further including a lid for closing the opening means of the cleaning chamber when the cleaning chamber is not in use, and a lid for closing the opening means of the rinse chamber when the rinse chamber is not in use.

14. The golf club head cleaning apparatus of claim 12, further including a soap solution positioned in the cleaning chamber, and a rinsing solution positioned in the rinse chamber.

15. The golf club head cleaning apparatus of claim 12, the base having drainage holes extending through the base which are not covered by either the cleaning chamber or the rinse chamber when the cleaning chamber and the rinse chamber are positioned on the base.

16. The golf club head cleaning apparatus of claim 12, the cleaning means being removable from the cleaning chamber.

17. A golf club head cleaning apparatus, comprising a cleaning chamber having an interior for housing a cleaning solution and an opening leading to the interior of the cleaning chamber, the opening to the interior of the cleaning chamber being sized to allow for passage of a golf club head therethrough, a rinse chamber having an interior for housing a rinsing solution and an opening leading to the interior of the rinse chamber, the opening to the interior of the rinse chamber being sized to allow for passage of a golf club head therethrough, and a base, the cleaning chamber having a cleaning device positioned therein, the cleaning chamber being releasably positioned on the base, the rinse chamber being releasably positioned on the base, the cleaning chamber, the rinse chamber, and the base being separable from one another, the cleaning device comprising a cleaning insert, the insert being dimensioned to fit within the cleaning chamber, and the insert having a hollow central portion extending from a bottom portion of the insert to a top portion of the insert, a top wall formed at the top portion of the insert, and a wall extending from the bottom portion of the insert to the top portion of the insert surrounding the hollow central portion, the bottom portion being open ended, and a cleaning material positioned within the hollow central portion of the cleaning insert, the top wall of the insert having an opening formed therein that leads to the hollow central portion of the insert, the opening formed in the top wall of the insert being sized to permit a golf club head to be inserted therethrough, the opening comprising an orienting structure that allows passage of a golf club head into the cleaning chamber only when the golf club head is in proper alignment with the cleaning material, and the opening in the top wall of the insert having two opposite long sides that are displaced from each other by a distance suitable to allow a width of a golf club head to pass therethrough but not large enough to allow passage of a length of a golf club head to pass therethrough.

18. The golf club head cleaning apparatus of claim 17, the cleaning material comprising brushes, rags, sponges, rope, or textile materials.

19. The golf club head cleaning apparatus of claim 17, the cleaning material being releasably mounted in the insert.

20. The golf club head cleaning apparatus of claim 17, the cleaning insert being removable from the cleaning chamber.

21. A golf club head cleaning apparatus, comprising a cleaning chamber having an interior for housing a cleaning solution and an opening leading to the interior of the cleaning chamber, the opening to the interior of the cleaning chamber being sized to allow for passage of a golf club head therethrough, a rinse chamber having an interior for housing a rinsing solution and an opening leading to the interior of the rinse chamber, the opening to the interior of the rinse chamber being sized to allow for passage of a golf club head therethrough, and a base, the cleaning chamber having a cleaning device positioned therein, the cleaning chamber being releasably positioned on the base, the rinse chamber being releasably positioned on the base, and the cleaning chamber, the rinse chamber, and the base being separable from one another, and further including a frame positioned on the base, the frame extending upwardly from the base for supporting the cleaning chamber and the rinse chamber, the frame having a first cutout shaped to compliment a portion of the cleaning chamber and a second cutout shaped to compliment a portion of the rinse chamber allowing the frame to support the cleaning chamber and the rinse chamber in upright positions, and a soap housing formed in the frame for holding a bottled cleaning solution.

22. The golf club head cleaning apparatus of claim 21, further including a bottled cleaning solution sized to be positioned in the soap housing.

23. A golf club head cleaning apparatus, comprising a cleaning chamber having an interior for housing a cleaning solution and an opening leading to the interior of the cleaning chamber, the opening to the interior of the cleaning chamber being sized to allow for passage of a golf club head therethrough, a rinse chamber having an interior for housing a rinsing solution and an opening leading to the interior of the rinse chamber, the opening to the interior of the rinse chamber being sized to allow for passage of a golf club head therethrough, and a base, the cleaning chamber having a cleaning device positioned therein, the cleaning chamber being releasably positioned on the base, the rinse chamber being releasably positioned on the base, and the cleaning chamber, the rinse chamber, and the base being separable from one another, the cleaning device comprising a cleaning insert, the insert being dimensioned to fit within the cleaning chamber, the insert having a hollow central portion extending from a bottom portion of the insert to a top portion of the insert, a top wall formed at the top portion of the insert, and a wall extending from the bottom portion of the insert to the top portion of the insert surrounding the hollow central portion, the bottom portion being open ended, a cleaning material positioned within the hollow central portion of the cleaning insert, the top wall of the insert having an opening formed therein that leads to the hollow central portion of the insert, the opening formed in the top wall of the insert being sized to permit a golf club head to be inserted therethrough, the opening comprising an orienting structure that allows passage of a golf club head into the cleaning chamber only when the golf club head is in proper alignment with the cleaning material, and the opening in the top wall of the insert having two opposite long sides that are displaced from each other by a distance suitable to allow a width of a golf club head to pass therethrough but not large enough to allow passage of a length of a golf club head to pass therethrough, the cleaning material comprising brushes, rags, sponges, rope, or textile materials, the cleaning material being releasably mounted in the insert, and further including a frame positioned on the base, the frame extending upwardly from the base for supporting the cleaning chamber and the rinse chamber, the frame having a first cutout shaped to compliment a portion of the cleaning chamber and a second cutout shaped to compliment a portion of the rinse chamber allowing the frame to support the cleaning chamber and the rinse chamber in upright positions, and a soap housing formed in the frame for holding a bottled cleaning solution, a bottled cleaning solution sized to be positioned in the soap housing, a lid for closing the opening of the cleaning chamber when the cleaning chamber is not in use, a lid for closing the opening of the rinse chamber when the rinse chamber is not in use, a soap solution positioned in the cleaning chamber, and a rinsing solution positioned in the rinse chamber, the base having drainage holes extending through the base which are not covered by either the cleaning chamber or the rinse chamber when the cleaning chamber and the rinse chamber are positioned on the base.

* * * * *